US007594771B2

(12) United States Patent
Mindler

(10) Patent No.: US 7,594,771 B2
(45) Date of Patent: Sep. 29, 2009

(54) SPOOL ADAPTER

(75) Inventor: Robert F. Mindler, Churchville, NY (US)

(73) Assignee: Eastman Kodak Company, Rochester, NY (US)

( * ) Notice: Subject to any disclaimer, the term of this patent is extended or adjusted under 35 U.S.C. 154(b) by 913 days.

(21) Appl. No.: 11/020,404

(22) Filed: Dec. 22, 2004

(65) Prior Publication Data

US 2006/0133879 A1 Jun. 22, 2006

(51) Int. Cl.
*B41J 17/32* (2006.01)
*B41J 35/28* (2006.01)

(52) U.S. Cl. ..... 400/243; 400/242; 400/246

(58) Field of Classification Search ..... None
See application file for complete search history.

(56) References Cited

U.S. PATENT DOCUMENTS

| | | | | |
|---|---|---|---|---|
| 3,713,601 | A | 1/1973 | Buhrman et al. | |
| 4,372,500 | A | 2/1983 | Saraisky | |
| 4,792,105 | A * | 12/1988 | Imaseki | 242/598.3 |
| 4,978,240 | A | 12/1990 | Katsuno | |
| 5,079,565 | A * | 1/1992 | Shimizu et al. | 347/172 |
| 5,393,149 | A * | 2/1995 | Iima | 400/208 |
| 5,513,920 | A | 5/1996 | Whritenor et al. | |
| 5,562,352 | A | 10/1996 | Whritenor et al. | |
| 5,615,845 | A | 4/1997 | Kewin | |
| 6,152,625 | A | 11/2000 | Oliverio | |
| 6,425,548 | B2 | 7/2002 | Christensen et al. | |
| 2005/0068409 | A1 * | 3/2005 | Igi et al. | 347/214 |

FOREIGN PATENT DOCUMENTS

| | | | |
|---|---|---|---|
| EP | 0 546 944 | | 6/1993 |
| EP | 1 066 974 | | 1/2001 |
| FR | 2 736 864 | | 1/1997 |
| JP | 60042082 A | * | 3/1985 |
| JP | 2005-199582 | | 7/2005 |

* cited by examiner

*Primary Examiner*—Daniel J. Colilla
(74) *Attorney, Agent, or Firm*—Roland R. Schindler, II

(57) ABSTRACT

An adapter is provided for use with a supply spool having first and second spool ends the spool having web media thereon. The adapter has a body having first and second body ends with each of the first and second body ends having shaped linkages to join to one of the first and second supply ends and with each body end further shaped to join to a printer receptacle when not joined to a spool end; and a data source. The body shaped to position the data source relative to the first body end so that when the first body end is joined to a first spool end, the data source is positioned to provide the machine readable data so that the machine readable data can be read by a reader in a printer that is adapted to accept a supply spool having web media that is axially located asymmetrically.

19 Claims, 13 Drawing Sheets

SPOOL ADAPTER

FIELD OF THE INVENTION

This invention relates generally to printers, and, more particularly, to an apparatus to ensure correct loading of a dye donor web wound upon a spool in a thermal printer.

BACKGROUND OF THE INVENTION

It is desirable to have printers such as thermal printers in which it is easy to accurately load the dye donor ribbon. It is further desirable to make the printer as easy to use as practical while being cost effective in the manufacturing process. Some thermal printers have a disposable dye donor cartridge mounted in the printer to hold the dye donor supply and take-up spools and offer convenience of use because it is relatively easy to insert and remove the cartridge. This is especially true in instances where the cartridge is keyed, sized, or shaped to be insertable with only one orientation. While cartridges offer convenience, they are expensive and in some cases the cartridges are discarded after one use. Unfortunately, attempts to make cartridges reusable to conserve resources have failed because it is difficult to rewind dye donor in a cartridge at the point of use.

To eliminate the problems associated with cartridges, some printers have configurations that mount the donor spools in the print engine without the benefit of a cartridge, while other printers mount the spool in the printer door, again without cartridges. Where spools are used without cartridges, there are also problems that arise. Space is always a consideration and there is not always sufficient room for all hands to manipulate the spools, regardless of whether the spools are full or empty. A spool can be mispositioned on the drive elements and therefore completely inoperative, or may cause annoying printing errors.

Failure to correctly orient the supply and take-up spools creates a situation wherein the printer will not function properly, if at all. Correct loading requires having the supply and take-up spools in their proper places as well as having the donor supply spool oriented correctly end for end. Incorrect end for end orientation causes the web to traverse an incorrect path through the printer, if it traverses a path at all. With an improperly loaded dye donor web, it is very difficult, if not impossible, to achieve exact color registration and produce a quality image without undesirable artifacts.

While a careful and skillful operator can study the spools and the spool receiving mechanism and achieve correct insertion of the supply and take-up spools, doing so is burdensome, even for a skilled operator. An operator does not want to read lengthy or complicated instructions or observe burdensome or annoying practices just to ready a machine for use, and typically has more than one machine to operate and desires convenience so that having to refer to manuals or read instructions is quite a burden. An operator wants to simply drop the donor web into place, especially where doing so is an occasional and unscheduled chore. Accordingly, it will be appreciated that it would be highly desirable to have an apparatus and method for simply and correctly loading a donor web wound upon a spool into the printer which prevents operation of the printer when incorrectly loaded.

Accordingly, commonly assigned U.S. Pat. No. 5,513,920 filed on Oct. 29, 1992 by Whritenor et al. describes a thermal printer apparatus comprising a supply spool having opposed cylindrical ends of substantially the same diameter and shape and a pair of spaced, rotatable, axially aligned spindles adapted to receive a respective one of said opposed ends of said supply spool, there being a correct end-for-end orientation of said supply spool and an incorrect end-for-end orientation of said supply spool on the spindles. The printer has a mechanical stop member in the space between said spindles and closer to one of the spindles than the other. A dye donor web to be used in the printer is wound on said supply spool to form a cylindrical roll which is axially shorter than said spool and axially off center of said spool so as to leave a substantially longer portion of the spool extending beyond one end of the roll than extends beyond the other end of the roll, whereby the roll will interfere with the mechanical stop member of a thermal printer of the type described when an attempt is made to insert the apparatus incorrectly in such a thermal printer, but will not interfere with the mechanical stop member of a thermal printer of the type described when an attempt is made to insert the apparatus correctly in such a thermal printer.

The '920 patent also describes a variety of other modifications that can be made to a web spool that can be used to help ensure that donor or receiver web spools are properly loaded into a printer media supply including but not limited to the use of differently sized donor and take up spools, donor and take up spools with differently shaped or sized ends, donor and take up spools of different length, and donor and/or take up spools having ends that are different.

Such mechanical solutions, while commercially viable and highly useful, requires that all media that is inserted into a printer that is so adapted conform to the requirements that are set by the manufacturer of such a printer. However, not all manufacturers agree upon such standards and therefore many makers of media provide media on spools that are adapted to be compatible only with a limited number of manufacturer's products or incur additional costs in providing a wide variety of different media types on different spools.

Another solution followed in many printers to prevent misloading is to apply a machine readable marking or indicator on the spools, a memory chip, or a wireless memory chip such as a Radio Frequency Identification transponder that can be read only when the spool is properly loaded. This solution, while also highly useful and valuable further increases media manufacturer costs in that the media manufacturer must not only provide mediums that are adapted to conform to the spool geometry and media geometry but must also provide an appropriate set of markings, properly programmed memory chips, or properly programmed RFID transponders, and must position such markings so that they can be detected properly.

What is desired therefore is a new approach to providing media supplies that allows a consumer to use a non-specific media in a printing device that is adapted to receive media of a specific type.

SUMMARY OF THE INVENTION

In a first aspect of the invention an adapter is provided. The adapter for use with a supply spool having first and second spool ends the spool having web media thereon. The adapter has a body having first and second body ends with each of the first and second body ends having shaped linkages to join to one of the first and second supply ends and with each body end further shaped to join to a printer receptacle when not joined to a spool end; and a data source. The body shaped to position the data source relative to the first body end so that when the first body end is joined to a first spool end, the data source is positioned to provide the machine readable data so that the machine readable data can be read by a reader in a printer that is adapted to accept a supply spool having web media that is axially located asymmetrically on the spool.

In another aspect of the invention, an adapter is provided for use with supply spool having first and second spool ends with media wound about said supply spool so that the media is generally equidistant from the spool ends. The adapter comprises a body having first and second body ends with each of the first and second body ends having shaped linkages to join to a respective one of the first and second supply ends and further shaped to join to a printer axel when not joined to a spool end, said body further comprising a data source positioned thereon. The body positions the data source relative to the first body end so that when the first body end is joined to the first spool end, the data source is positioned to provide the machine readable data so that the machine readable data can be read by a reader in a printer that is adapted to accept a supply spool having media that is axially located asymmetrically closer to the second end. The body further positions the data source so that when the second body end is joined to the second spool end, the data source is positioned to provide machine readable data so that the machine readable data can be read by a reader in a printer that is adapted to accept a supply spool having media that is axially located asymmetrically closer to the first end.

In another aspect of the invention, an adapter is provided. The adapter has a data means for providing machine readable data, and an extension means for extending the length of a spool having two ends, the extension means having a means for connecting to at least one end of the spool. Wherein the means for connecting provides more than one manner for connecting the extension means to an end of the spool for rotation therewith, and wherein the extension means positions the data means so that the data means can be read by a reader in a printer that is adapted to receive an extension means that is connected to a spool in any of the more than one manner.

DETAILED DESCRIPTION OF INVENTION

Loading Apparatus

Figure 1:
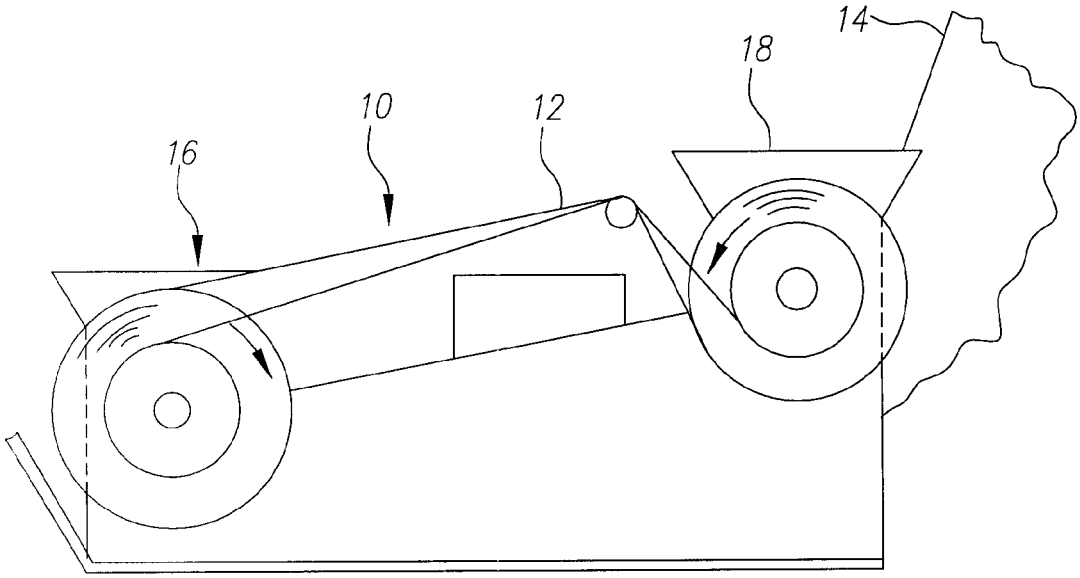
FIG. 1 (Prior Art)
FIG. 1 is diagrammatical longitudinal sectional view of a thermal printer with the cover open exposing dye donor web loading guide supports in accordance with the present invention.
Figure 2:
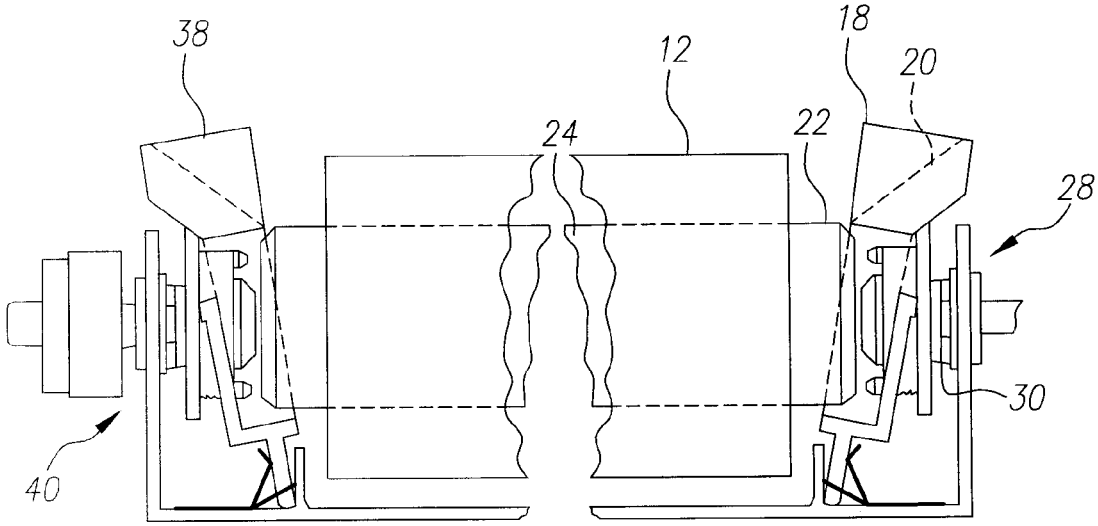
FIG. 2 (Prior Art)
FIG. 2 is a somewhat enlarged, diagrammatic view of a prior art spool being inserted into the receptacles of FIG. 1 with some parts shown in section and some parts cut away.
Figure 3:
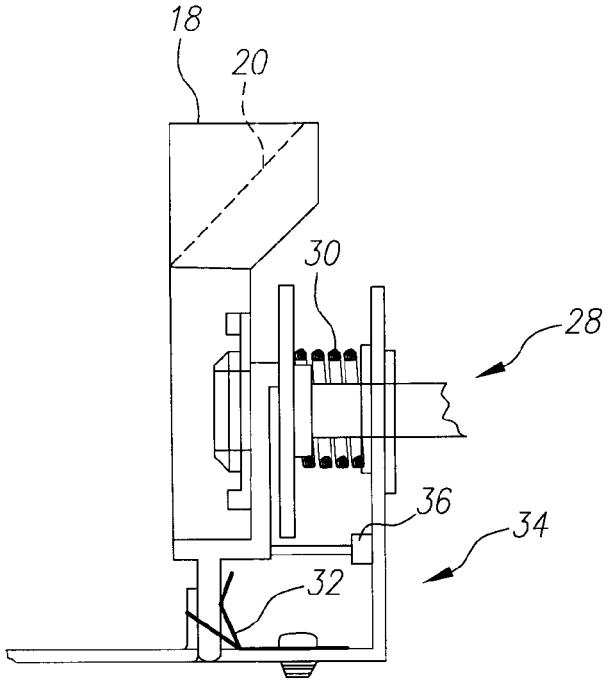
FIG. 3 (Prior Art)
FIG. 3 is side view of a prior art receptacle similar to the view shown in FIG. 2, but illustrating the guide support in the locked position.
Figure 4:
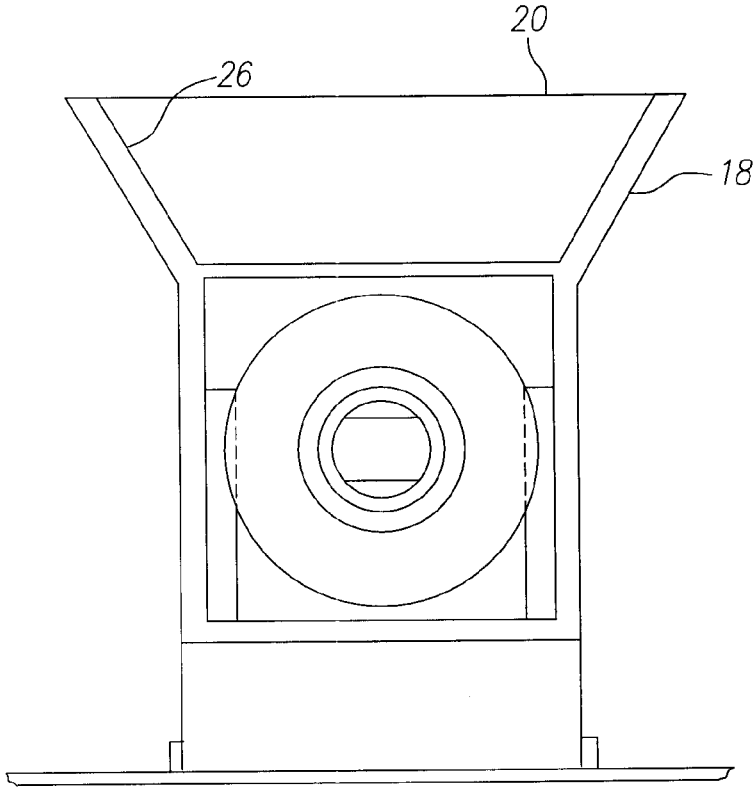
FIG. 4 (Prior Art)
FIG. 4 is a left side view of the guide receptacle illustrated in FIG. 3.

Referring to FIGS. 1–2, a loading apparatus 10 for loading a dye donor web 12 into a thermal printer is illustrated. The printer has a base portion 14 and a door or cover portion 16 that is hingedly connected to the base portion 14 and movable between a closed position and an open position. At the closed position, the door 16 abuts the base 14, and, at the open position, the door 16 is swung away from the base 14 forming an angle greater than about 90 degrees. The door 16 swings an arc greater than 90 degrees in moving from the closed position to the open position to thereby provide easy access for inserting a new dye donor web and removing an expended dye donor web.

The dye donor web loading apparatus 10 includes a first guiding support mechanism or receptacle 18 attached to the door 16 and movable between a locked position and an unlocked position. The receptacle 18 has a slot 20 therein that is dimensioned to receive an end portion 22 of a dye donor web supply spool 24. The slot 20 has a tapered portion 26 for guiding an end portion 22 of the spool 24. Preferably, the end portion 22 of the spool 24 is also slightly tapered. The dye donor web loading apparatus 10 also includes a first means for biasing the first receptacle 28 toward the locked position. The first means 28 preferably includes a coiled spring 30 in contact with the first receptacle 18 for biasing the first receptacle 18 towards the locked position.

Referring to FIGS. 1–4, the loading apparatus 10 includes a bracket 32 pivotally connected to the first receptacle 18 and fastened to the door 16 of the thermal printer. The bracket 32 engages the first receptacle 18 to thereby limit travel of the receptacle 18 towards the locked position.

The web loading apparatus 10 includes means 34 for detecting when the first guide receptacle 18 is in the locked position. The means 34 may include a microswitch 36 or other device to sense the position of the guide receptacle 18.

The dye donor web loading apparatus 10 includes a second receptacle 38 that is spaced from the first receptacle 18 and attached to the door 16. The second receptacle 38 is movable between a locked position and an unlocked and works in concert with first receptacle 18 to receive a dye donor web spool 24. As with the first receptacle 18, the second receptacle 38 is biased by a biasing means 40 toward the locked position.

Referring to FIGS. 1–5, just as the first and second receptacles 18, 38 form a pair of members and act concert to load the web 12, so do third and fourth receptacles 42, 44. The third and fourth members 42, 44 are constructed in a similar manner to the first and second receptacles 18, 38 and include biasing means, not shown but similar to coiled spring 30 of FIGS. 2 and 3. The first pair of receptacles 18, 38 receives supply spool 24*a* while the second pair of receptacles 42, 44 receives the take-up spool 24*b* so that the dye donor web 12 can be wound from supply spool 24*a* onto the take-up spool 24*b* as the web 12 traverses a path through the printer to effect thermal printing.

Figure 5:
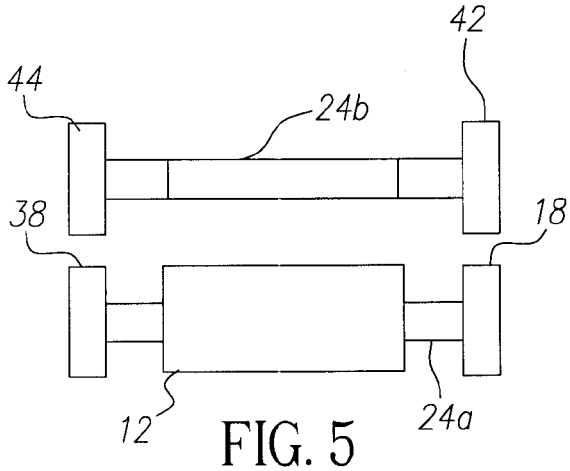
FIG. 5 (Prior Art)
FIG. 5 is a diagrammatic view illustrating the alignment of supply and take-up spools.

Referring to FIG. 5, the take-up spool 24*b* is illustrated with a color coded end portion to match a color coded receptacle 42 or other color keyed or coordinated part of the thermal printer. The color code provides an easy visual identification for the operator to ensure correct insertion of the take-up spool without the need to read any instructions. As illustrated, the take-up spool 24*b* is symmetrical so that end for end swapping is not a concern, but color-coding helps distinguish between the supply and take-up spools for operator convenience. The donor supply spool 24*a* may also be color coded or color coordinated, or have other indicia; however, a certain method for avoiding incorrect insertion is having the diameter of the supply spool 24*a* differ from the diameter of the take-up spool 24*b* so that the two spools cannot be interchanged.

As illustrated in FIG. 5, the diameter of the supply spool 24*a* is larger than the diameter of the take-up spool 24*b* which prevents the donor supply spool 24*a* from being inserted into the receptacle slots intended for the take-up spool 24*b*. While the smaller diameter take-up spool 24*b* fits into slots intended for the larger diameter supply spool 24*a*, there will be noticeable looseness to indicate that the spool is not correctly installed. Also, because both a supply spool and a take-up spool are required for operation, inserting the take-up spool 24*b* into the incorrect slots only results in the supply spool 24*a* not fitting in the remaining slots, which immediately indicates an error. Of course, the error can be quickly corrected by observing the color code.

Figure 6:
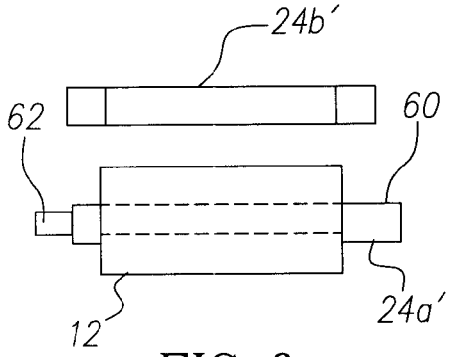
FIG. 6 (Prior Art)
FIG. 6 is a diagrammatic view similar to FIG. 5, but illustrating another prior art embodiment wherein the diameter of each end of the supply spool is different for correct loading.

Referring to FIG. 6, the supply spool 24*a*' has a first end portion 60 to fit into the slot of the first receptacle, and a second end portion 62 to fit into the slot of the second receptacle. The first end portion 60 has a larger diameter than the second end portion 62, and the slots and the receptacles are designed to receive those respective diameters to prevent end for end swapping and incorrect loading. Thus, the large diameter of first end portion 60 is too large to fit into the slot for the second receptacle. The web 12 is centered on the spool 24*a*', and, while end for end swapping may not matter with regard to the donor path, it is desirable to have a certain end for end orientation to facilitate the use of coded dye donor web.

As illustrated, the large diameter continues through the body of the supply spool 24*a*' so that the dye donor web is wound about a large diameter body. Where it is desired to have a longer donor web without increasing space requirements, the diameter of the main body of the spool 24*a*' may be the smaller diameter. While it is preferred that the diameter of the spool 24*a*' in contact with web be uniform, it is not necessary to have a uniform diameter in contact with the web. It is sufficient that the web can be uniformly and smoothly wound onto the supply spool and removed from the supply spool.

Still referring to FIG. 6, swapping of the supply spool 24*a*' and take-up spool 24*b*' can be prevented by having one spool longer than the other spool. It is preferred, however, to have both spools the same length to simplify manufacturing operations.

Figure 7:
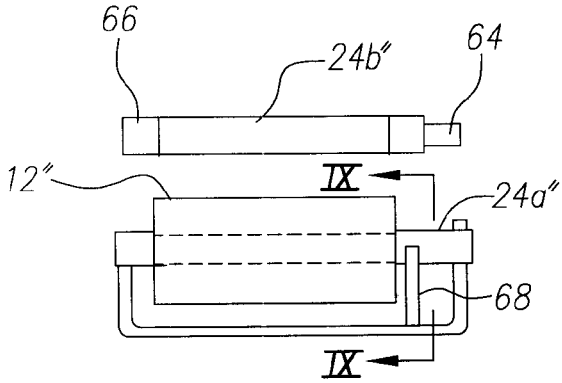
FIG. 7 (Prior Art)
FIG. 7 is a diagrammatic view similar to FIGS. 5 and 6, but illustrating another preferred embodiment with an offset dye donor web and a mechanical stop for correct loading.
Figure 8A:
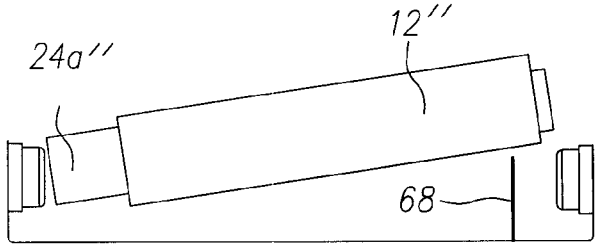
FIG. 8A (Prior Art)
FIGS. 8A–8D illustrate four possible methods for loading the supply spool.
Figure 8B:
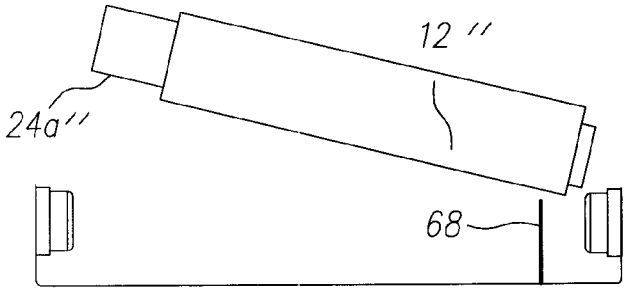
FIG. 8B (Prior Art)
Figure 8C:
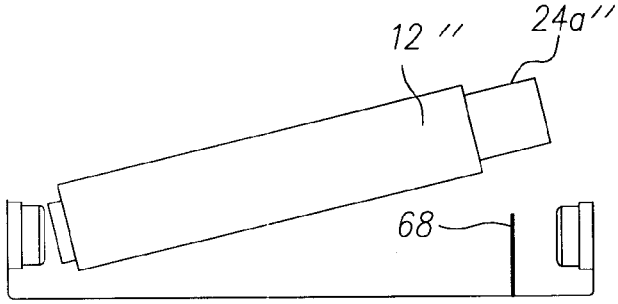
FIG. 8C (Prior Art)
Figure 8D:
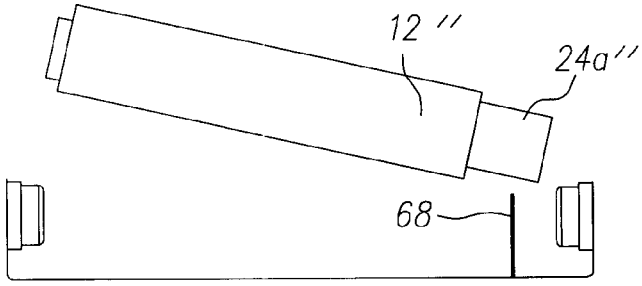
FIG. 8D (Prior Art)

Referring to FIG. 7, the take-up spool 24*b*" can also have end portions of different diameters to mate with different diameters of the receptacles. The first end portion 64 of the take-up spool 24*b*" is smaller in diameter than the second end portion 66 of the take-up spool 24*b*". Alternatively, the first end portion 64 could be larger in diameter than the second end portion 66. This will also prevent incorrect end for end insertion of the take-up spool. It is preferred, however, that the diameter be uniform to facilitate construction by an extrusion process.

FIG. 7 also illustrates another method for preventing incorrect end for end insertion of the donor web supply spool 24*a*" in the case of a donor web 12" that is not centered on the supply spool 24*a*" but is displaced towards one end of the spool. To prevent incorrect end for end insertion of the supply spool 24*a*", a mechanical stop member 68 is used. The mechanical stop 68 will engage the web 12" on the spool 24*a*" if the spool is inserted incorrectly end for end and prevent the ends of the spool from locking into position in the slots in the guide receptacles.

The mechanical stop 68 may be a protrusion extending from the bracket 19 on which the receptacles are mounted. Alternatively, the mechanical stop could be a member attached to or mounted on the frame of the door or other member of the thermal printer. The stop is preferably part of the bracket 19, and formed thereon by a metal stamping process which cuts and then bends a portion of the bracket to form the upstanding protrusion. The stop may be a single member or multiple members may be formed (FIG. 9).

Figure 9:
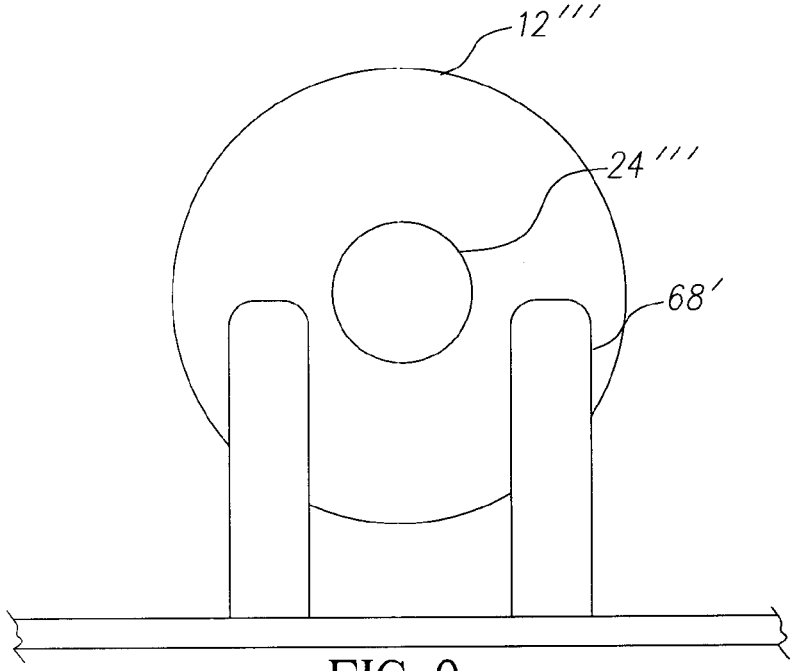
FIG. 9 (Prior Art)
FIG. 9 is a diagrammatic sectional view taken along line IX—IX of FIG. 7, but illustrating another prior art embodiment of an offset dye donor web end mechanical stop for correct loading.

Referring to FIGS. 7–9, an important aspect of the invention is the donor-printer interface when the supply spool is inserted onto the printer. This aspect features a dye donor web wound offset from the center of the supply spool so that the protrusion of one end portion of the spool from the web is more than the protrusion of the other end portion. A mechanical stop in the printer is positioned so that the longer end of the supply spool can pass the mechanical stop to mate with a spool receptacle. If the operator tries to insert the wrong end of the supply spool into the printer, the dye donor wound on the supply spool will engage the mechanical stop before the supply spool can seat properly (FIGS. 8A and 8B). This means that the supply spool can be installed in the printer in only one way thereby ensuring correct end for end orientation in the printer (FIGS. 8C and 8D). The mechanical stop could be a single element located near the supply spool location (FIG. 7), or a pair of symmetrically positioned elements straddling the location of supply spool 24'" (FIG. 9). Also, the stop could be a dedicated element that only performs the mechanical stop function, or it could be a portion of some other printer element to perform the stop function as an auxiliary function.

Because space is normally at a premium in a thermal printer, the door will not close properly when the donor supply spool is not correctly seated. Without the proper door-base interface intact, certain electrical circuits are broken to prevent inadvertent electrical shock and unintentional operation of the printer. Thus, when the dye donor spool is not correctly inserted, dye donor is conserved when the unseated spool breaks the door-base thereby preventing operation of the printer. Because it is undesirable to operate the printer when there is zero probability of producing a print of acceptable quality, an incorrectly seated dye donor spool breaks the door-base interface and prevents the printer from printing. This process prevents valuable dye donor from being wasted.

As illustrated in FIG. 8, there are four possible ways to insert the dye donor spool with the web wound thereon. FIGS. 8A, 8B illustrate the incorrect loading method for the dye donor spool. While the protruding end of the spool can partially engage the receptacle in FIG. 8A, the short end of the spool will not be able to engage the other receptacle because the stop member will intercept the dye donor web to prevent the spool from being correctly seated. In FIG. 8B, when it is attempted to insert the shorter protruding end, the stop member immediately intercepts the web to prevent the spool from being inserted. Thus, as illustrated in FIGS. 8A and 8B, the spool cannot be inserted when the short end is oriented to the right where the stop member can intercept the web. On the other hand, FIGS. 8C and 8D show that the spool can be loaded when the longer protruding end of the spool is oriented to the right where it cooperates with the stop member.

In the embodiment of FIGS. 6–8, the door is opened past vertical to make the inside fully accessible. A new dye donor web is then installed by aligning one spool with the two slots that face each other in one guide assembly that face each other to receive the spool. The proper guide slots can be chosen by observing the indicia or color code, noting the alignment of the donor web on the spool, noting the length of the spools, or noting the diameters, whichever applies. Where colors or indicia are used, these are matched. Where spool lengths or diameters are different, only one spool will fit each pair of receptacles. And where the donor web is off center, the mechanical stop prevents incorrect end for end insertion. The aligned spool is pushed into the facing slots thereby causing the guide members to unlock and move against the biasing springs. As the spool is pushed farther, the guide members spring back locking the spool in position. The other spool is inserted into its guide members the same way. The tapered ends of the spools act as self-centering devices to aid the alignment. The tapered ends also aid in removal of a used spool which is removed by pulling it straight out of the slots. If desired, one receptacle may be pushed aside to assist removal, but pushing is not necessary.

Using the above described dye donor web loading apparatus for a thermal printer can help to ensure correct loading of the supply and take-up spools and prevent incorrect loading of the dye donor supply spool. Loading is correct with respect to the supply and take-up spools being in the proper receptacles, and with respect to each spool being correctly oriented in its receptacles. The first and second receptacles 18, 38 may be conveniently spaced from one another a different distance than the third and fourth receptacles 42, 44 to accommodate supply and take-up spools of different lengths. Having the supply spool 24*a* longer or shorter than the take-up spool 24*b* prevents incorrect insertion of the spools caused by swapping the spools. Having different lengths also allows the web 12 to be centered on one spool but not the other to prevent swapping and incorrect insertion in the thermal printer. The receptacles 18, 38, 42, 44 may be color coded along with the ends of the spools to give a visual indication of correct insertion orientation. The slots in the first and second receptacles may have dimensions different from the slots in the third and fourth receptacles to receive spools of different diameters or cross section. This construction prevents swapping of the supply and take-up spools. Also, each slot in a pair of slots may have different diameters or cross-sections to prevent end for end swapping of a spool and incorrect loading. The slots may have tapered portions to aid in inserting the spools.

Data Transfer System

In certain applications, a donor supply spool 24 is adapted to provide data to printer 70 with the printer 70 being adapted so that appropriate data can only be read from donor supply spool 24 when donor supply spool 24 is properly loaded therein. This approach can be used with or without the mechanical adaptations to the donor supply spool 24 and/or holders described above for the same purpose.

Figure 10:
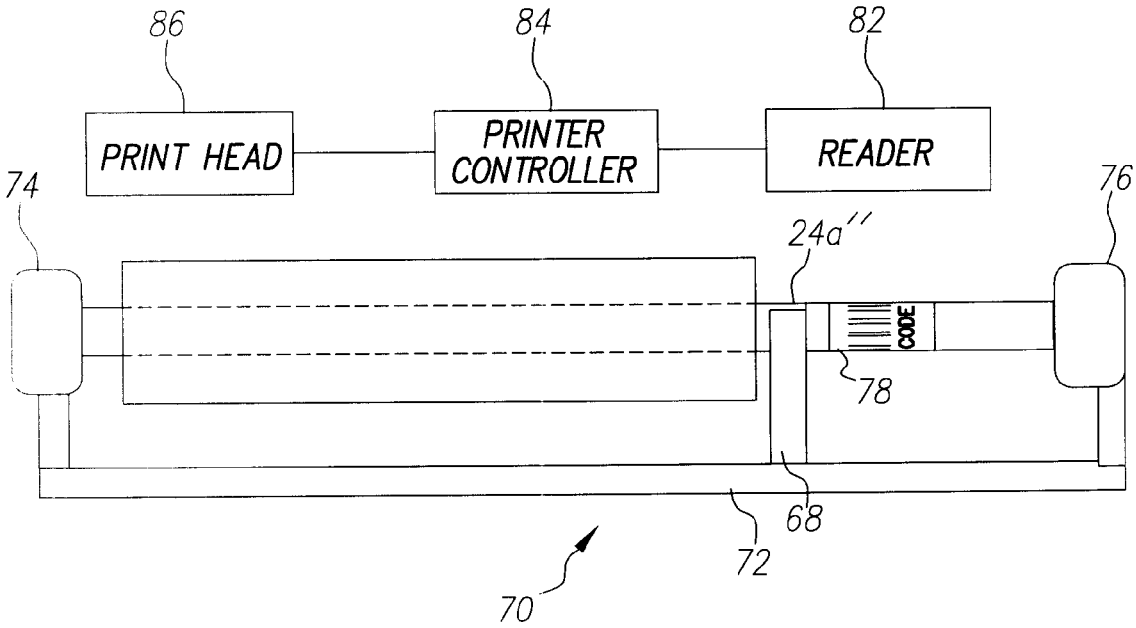
FIG. 10 (Prior Art)
FIG. 10 illustrates a conventional printer system having a donor spool with markings providing data thereon adapted to be read by a data reader in a conventional printer.

FIG. 10 shows one way in which this can be done. In the shown in FIG. 10, a printer 70 holds donor supply spool 24*a*" in for example holder 72. Holder 72 provides holds donor supply spool 24*a*" between two receptacles 74 and 76 that position donor supply spool 24*a*" for rotation about an axis. Donor supply spool 24*a*" has markings 78 or other encodements that are recorded on the donor supply spool 24*a*". Often markings 78 are located on an edge of a donor supply spool 24*a*", on an endcap (not shown) on donor supply spool 24*a*", or as shown such markings can be located in an area 80 of spool 24*a*" that provides the offset loading of the medium in holder 72 having stop 68 as there is substantial space in this area that is otherwise unused and as printer 70 can conveniently interpose a reading device 82 in this space. Reader 82 reads the markings, typically by applying a light to the marking and sensing the modulation of the reflected light during rotation of the spool and generates signals that a printer controller 84 can use, for example, to operate print head 86 or from which printer controller 84 can determine whether supply spool 24*a*" is properly loaded.

Figure 11:
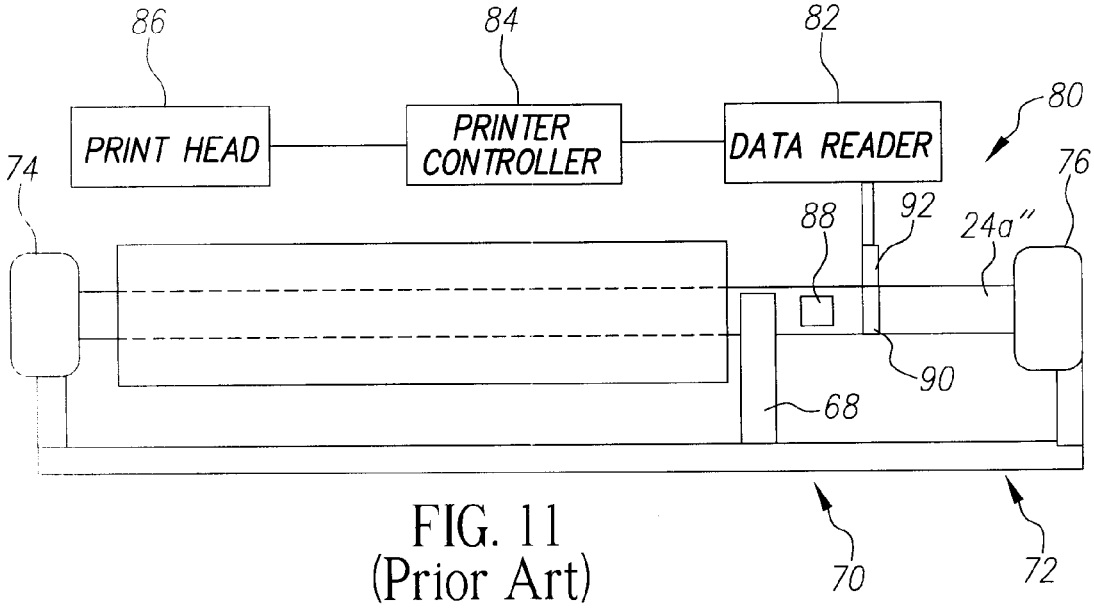
FIG. 11 (Prior Art)
FIG. 11 illustrates a conventional spool arrangement with a memory and contact adapted to provide data to be read by a conventional printer.

FIG. 11 shows another embodiment of a printer 70 that is adapted to read information from a donor supply spool 24*a*". As is shown in FIG. 11, a spool 24*a*" has a semi-conductor memory 88 thereon that has one or more contacts 90 or connectors (not shown) that allow a reader 82 having a co-designed reader contact 92 to communicate with memory 88 when spool 24*a*" is loaded therein to generate signals that a printer controller 84 can use, for example, to operate print head 86 or from which printer controller 84 can determine that the donor supply spool 24*a*" is not properly loaded.

Figure 12:
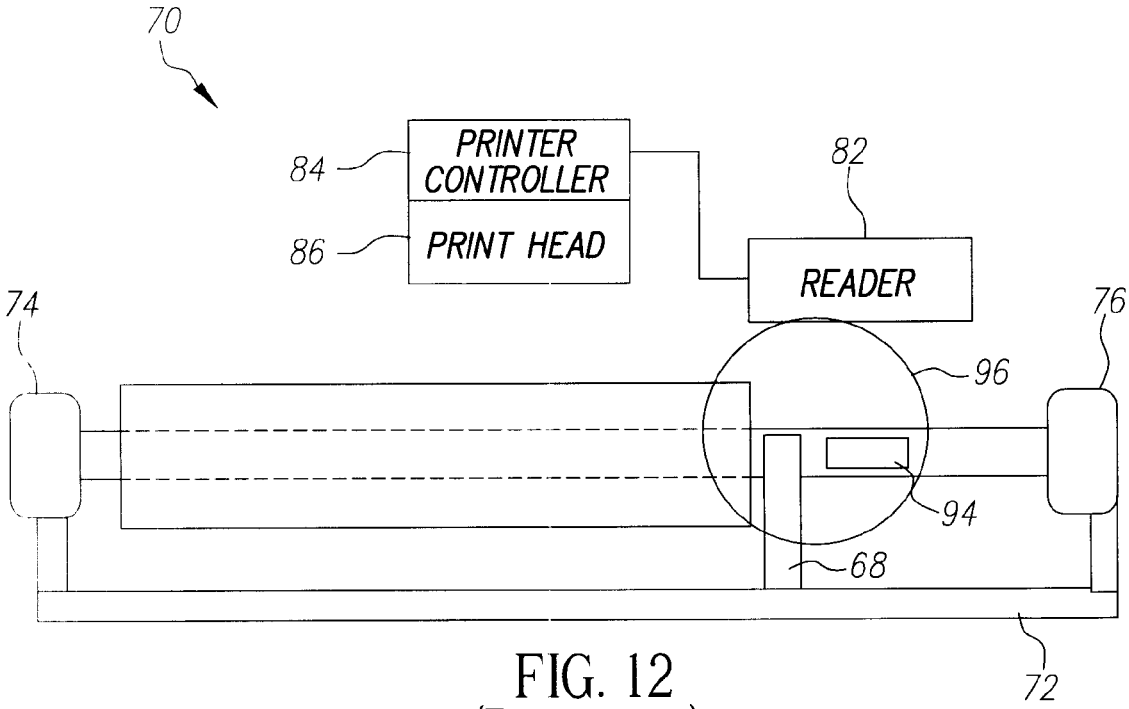
FIG. 12 (Prior Art)
FIG. 12 illustrates a conventional spool arrangement with a memory and a transponder adapted to provide wireless signals having data to be read by a conventional printer.

FIG. 12 shows another embodiment of a printer 70 that is adapted to read information from a donor supply spool 24*a*". As is shown in FIG. 12, spool 24*a*" has a radio frequency transponder 94 thereon that generates one or more electrical signals that allow a reader 82 having a co-designed radio frequency communication system located within a range 96 to communicate therewith. Reader 82 generates signals that a printer controller 84 can use, for example, to operate print head 86 or from which printer controller 84 can determine whether donor supply spool 24*a*" is properly loaded.

Figure 13:
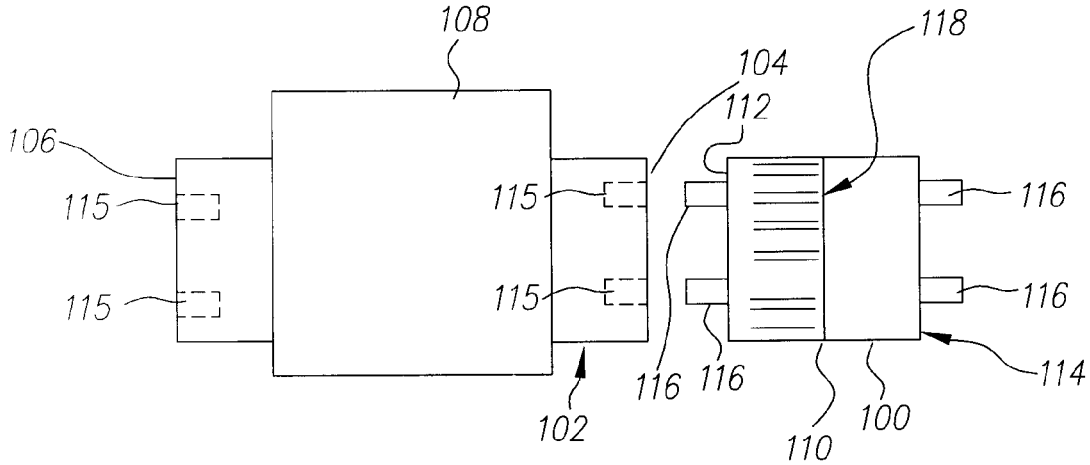
FIG. 13 illustrates one embodiment of an adapter of the invention.

A reader 82 of FIGS. 11, 12 or 13 can read data from markings 78, memory 88 or transponder 94 and such data can be used for other purposes such as to obtain data that characterizes the type of media loaded thereon, the age of the media, color characteristics of the media, and or other information useful in optimizing printer performance using such media.

Accordingly, it is important that any spool having media web thereon should provide any data that is required to operate a printer 70 to the printer in the manner in which a reader 82 in such a printer 70 is configured to read the data.

Adapter

FIG. 13 shows one embodiment of an adapter 100 of the invention. Adapter 100 is shaped for use with a supply spool 102 having a first spool end 104 and a second spool end 106. A media web 108 is wound about said supply spool. In the illustrated embodiment, media web 108 is wound about the supply spool 102 so that media web 108 is generally equidistant from the first spool end 104 and second spool end 106. However this is not necessary.

In the embodiment of FIG. 13, adapter 100 is shown having a body 110 with a first body end 112 and a second body end 114 with each of the first body end 112 and second body end 114 shaped to join one of the first spool end 104 and second spool end 106. First body end 112 and a second body end 114 are further shaped to join to a receptacle, such as receptacle 74 or 76, of holder 72 when not joined to one of first spool end 104 and second spool end 106.

In the embodiment illustrated in FIG. 13, first spool end 104 has shaped recesses 115 that are adapted to receive projections 116 provided on first body end 112 to define mechanical linkage therebetween. A wide variety of known mechanical structures can be used to provide such a linkage, including arrangements of pins, snap fit arrangements, adhesives, Velcro™, fasteners, interlocking structural features, and the like.

Figure 14:
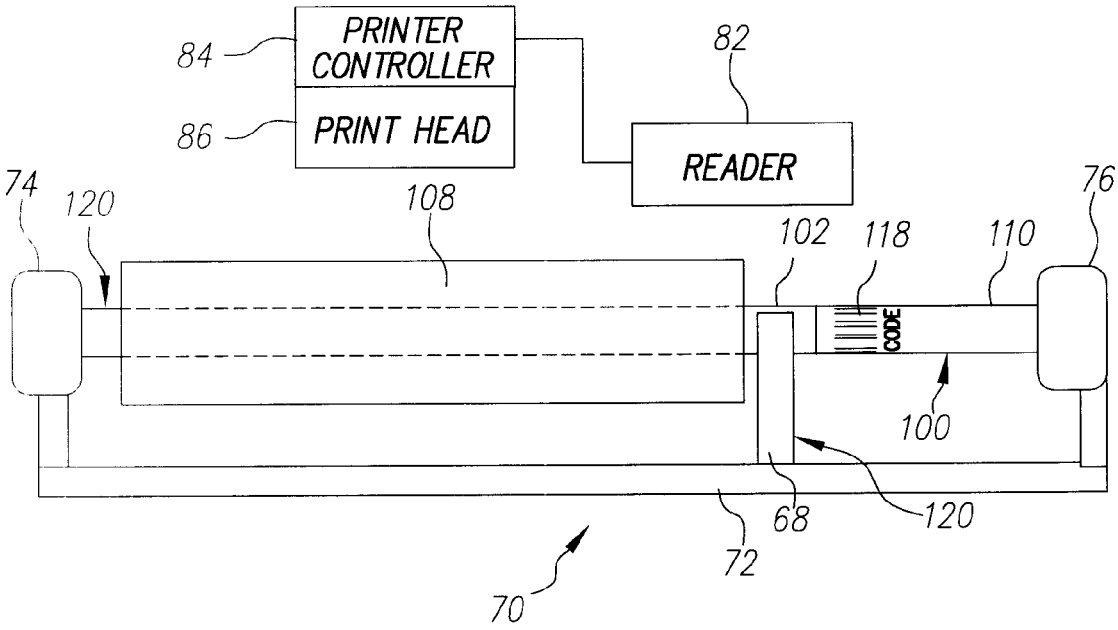
FIG. 14 shows the embodiment of FIG. 13 installed in a printer.

FIG. 14 shows adapter 100 with supply spool 102 of FIG. 13 combined to provide an adapter/spool assembly 120. As is shown in FIG. 14, spool 102 does not have sufficient length to extend from receptacle 74 to receptacle 76, however, adapter 100 provides a body 110 that has sufficient length to extend spool 102 so that spool 102 can be loaded into holder 72 and held by receptacles 74 and 76. Further, body 110 positions web 108 on assembly 120 so that assembly 120 can be loaded into printer 70 without interference from stop 68. In this way, a supply spool 102 having a web 108 loaded symmetrically thereon or loaded thereon with an offset that is not of sufficient extent can be inserted into first printer 70 requiring an offset of a particular extent.

As is also shown in FIGS. 13 and 14, adapter 100 has a data source 118. Data source 118 has some form of machine-readable data stored therewith that can be read by reader 82 of printer 70. In the embodiment illustrated, machine-readable data comprises a bar code and markings on body 110 form the bar code. However, in other embodiments, the data source 118 can comprise characters, numbers, bar code markings, symbols, encodements, watermarks, or other indicia on body 110 that can be detected based upon a pattern of light that reflects from body 110.

Body 110 is shaped to position data source 118 so that when first body end 112 is joined to first spool end 104, data source 118 is positioned so that the machine readable data can be read by a reader 82 in printer 70, that is adapted to accept a spool assembly 120 having media web 108 that is axially located asymmetrically closer to second spool end 106 than to second body end 114 which, as shown in FIG. 14, links assembly 120 to receptacle 76. In the embodiment of FIGS. 13 and 14, this asymmetrical arrangement allows assembly 120 to be loaded into a printer 70 having a stop 68 that requires asymmetrical loaded supply spools such as spool 24*a*". Optionally body 110 is further shaped to position data source 118 so that so that when second body end 114 is joined to first spool end 104, data source 118 is positioned to provide machine readable data so that the machine readable data can be read by a reader 82 in a printer that is adapted to accept a supply spool having media that is axially located asymmetrically closer to the second spool end 106.

Figure 15:
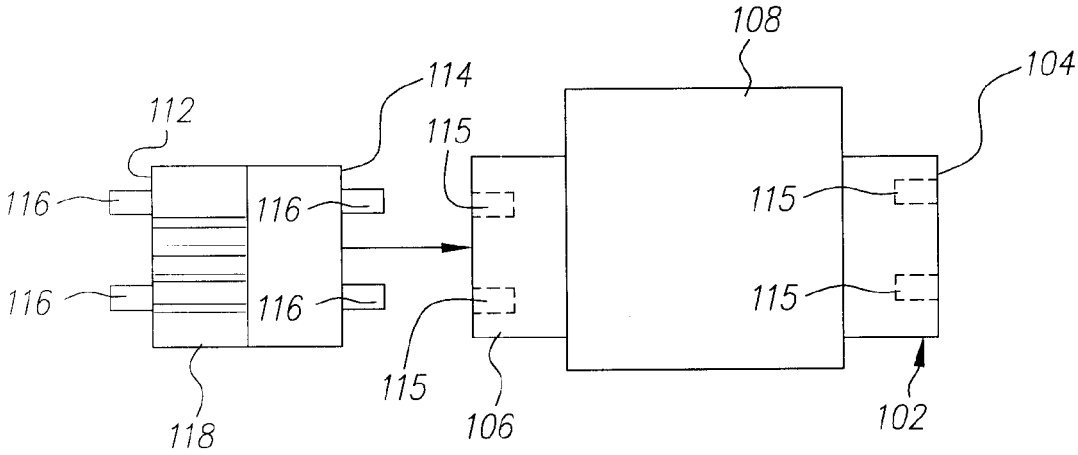
FIG. 15 illustrates the attachment of the embodiment of the adapter of FIG. 1 to a different end of a spool.
Figure 16:
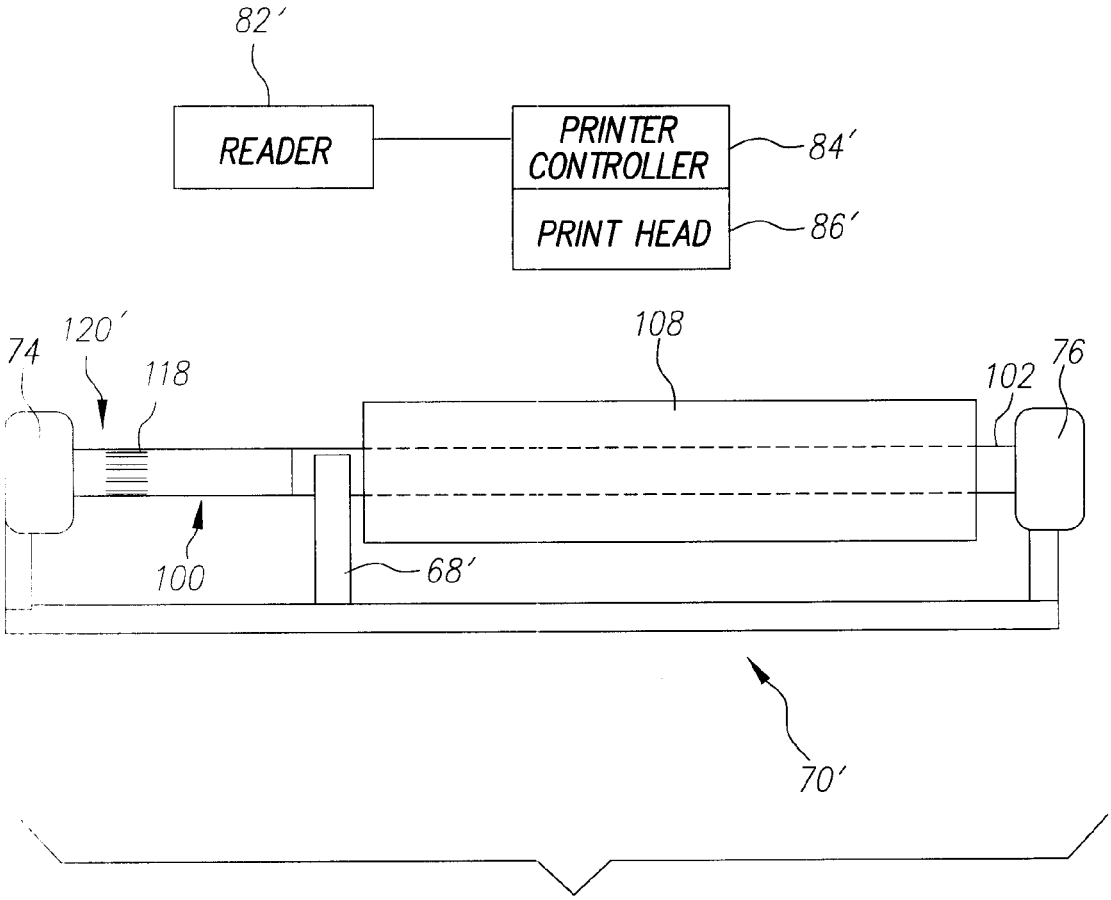
FIG. 16 shows the adapter and spool of FIG. 15 loaded in a printer.

FIG. 15 shows an alternate arrangement of the adapter 100 of FIG. 13 wherein second body end 114 of adapter 100 is joined to second end 106 of supply spool 102. It will be appreciated that, in this embodiment an assembly 120' is formed that provides a web media offset that is the inverse of the offset provided by assembly 120 and that is useful in a printer 70' that is adapted to receive a supply spool assembly 120' having a web media that is axially located asymmetrically closer to first spool end 104 than to first body end 112. As shown in FIGS. 15 and 16, printer 70' has a stop 68' that requires an asymmetrically loaded supply spool that is offset in a manner that is the converse of the manner in which supply spool 24*a*" is loaded. As is also shown in this embodiment data source 118 is positioned by body 110 so that it can be read by a reader 82'.

Importantly, in this embodiment data source 118 is positioned in a manner so that reader 82' can read data from data source 118 in a manner that is consistent with the manner that data reader 82' anticipates that such data will be presented to by a conventional supply spool. In this regard, it will be appreciated that reader 82' can be adapted to read data as a supply spool is rotated past reader 82' in a counterclockwise direction (as viewed from receptacle 74). If adapter 100 was not adapted in this manner but simply flipped over when joined to spool 20, so that the first body end 112 is joined to the second spool end 106, data source 118 would be advanced past reader 82' in a reversed order. This could lead to confusion on the part of reader 82' or printer controller 84'. However, body 110 of FIGS. 13–16 avoids this problem by positioning data source 118 so that data can be read therefrom when second body end 114 is joined to second body spool end 106. In another embodiment, body 110 can be adapted to position data source 118, so that data can be read therefrom when either of the first body end 112 and second body end 114 are joined to first spool end 104 or second spool end 106.

Figure 17:
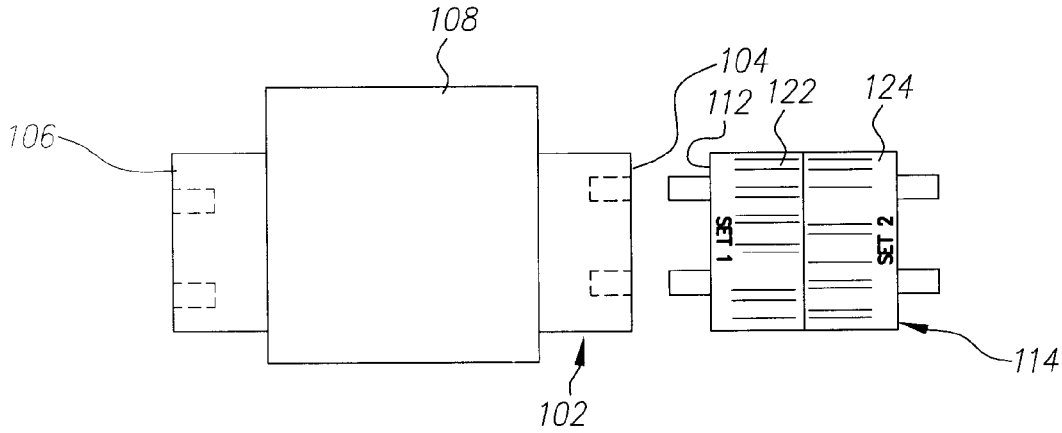
FIGS. 17–18 illustrate another embodiment of an adapter joined to a spool to provide a first set of data to a printer.
Figure 18:
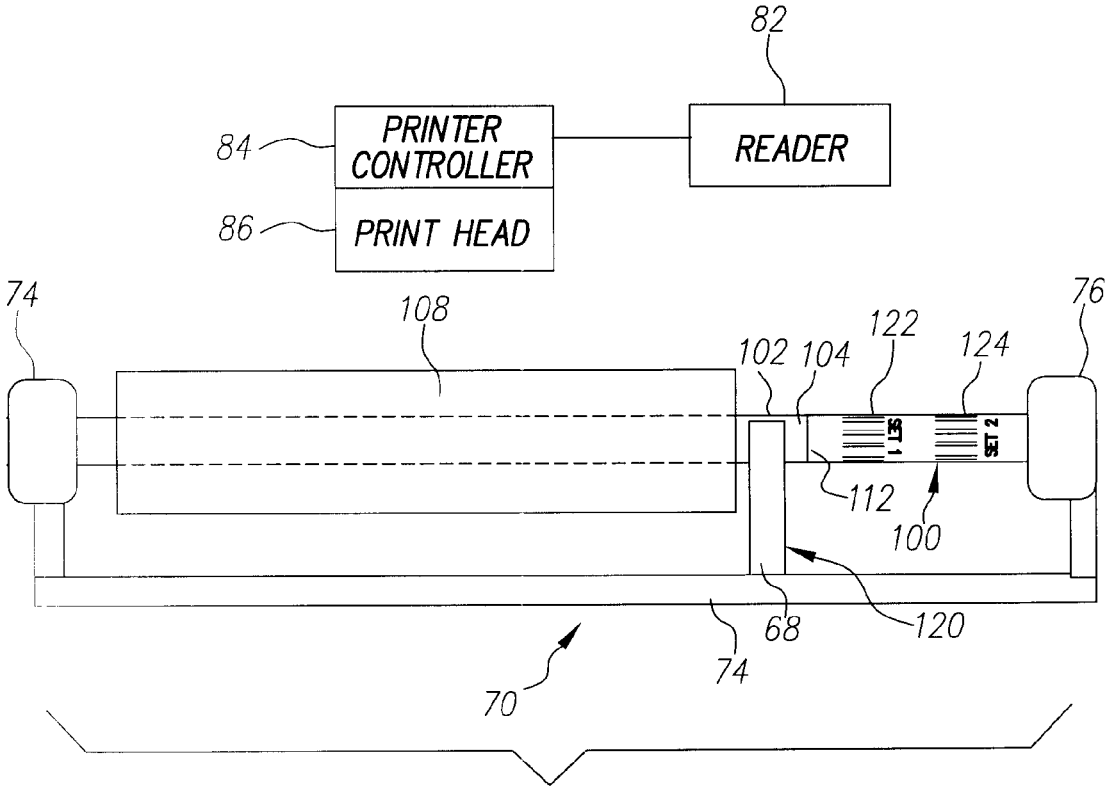
Figure 19:
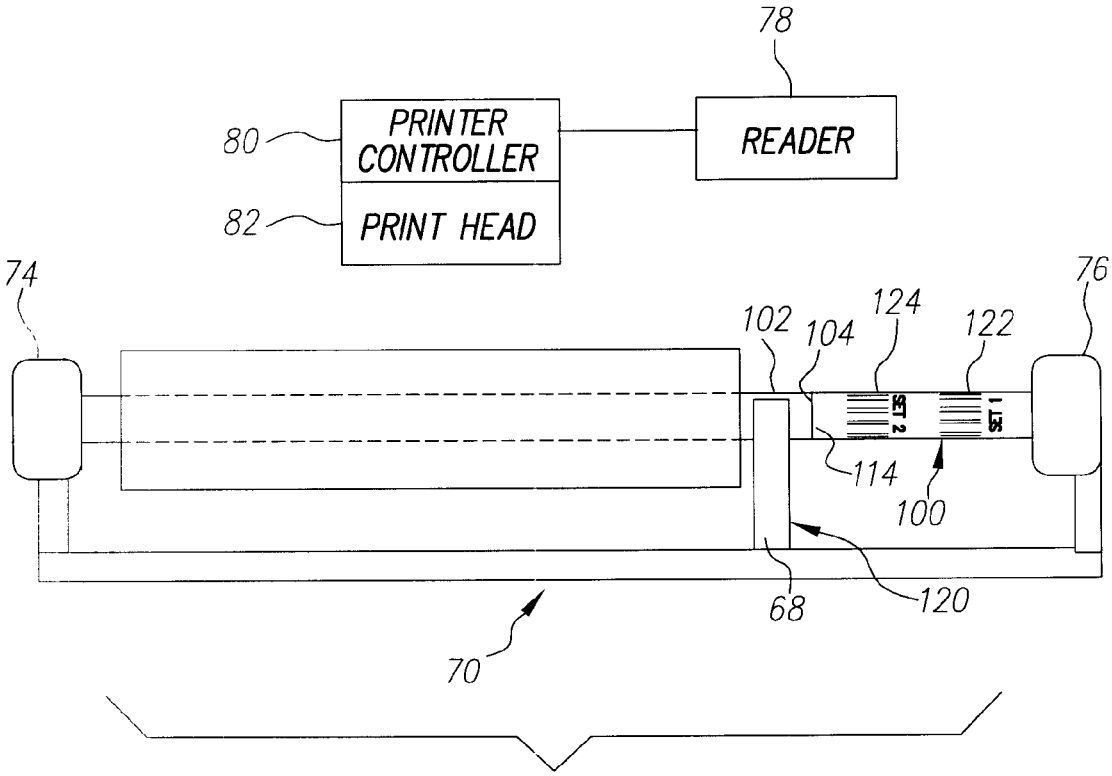
FIG. 19 shows the adapter of FIGS. 17 and 18 joined to the spool of FIG. 18 so that a different set of data is provided to a printer.

It will be appreciated that printer 70 and printer 70' may require different data from data source 118. Accordingly, in one embodiment illustrated in FIGS. 17 and 18, body 110 has a data source 118 with a first set of data 122 and a second set of data 124 that can be detected based upon a pattern of light that reflects from body 110 so that when first end 112 is joined the first spool end 104, first set of data 122 is presented to reader 82. As is further illustrated in FIG. 19, second body end 114 is connected to first spool end 104 as shown and/or to second spool end 106 (not shown) data source 118 presents second set 124 presented to reader 82.

Figure 20:
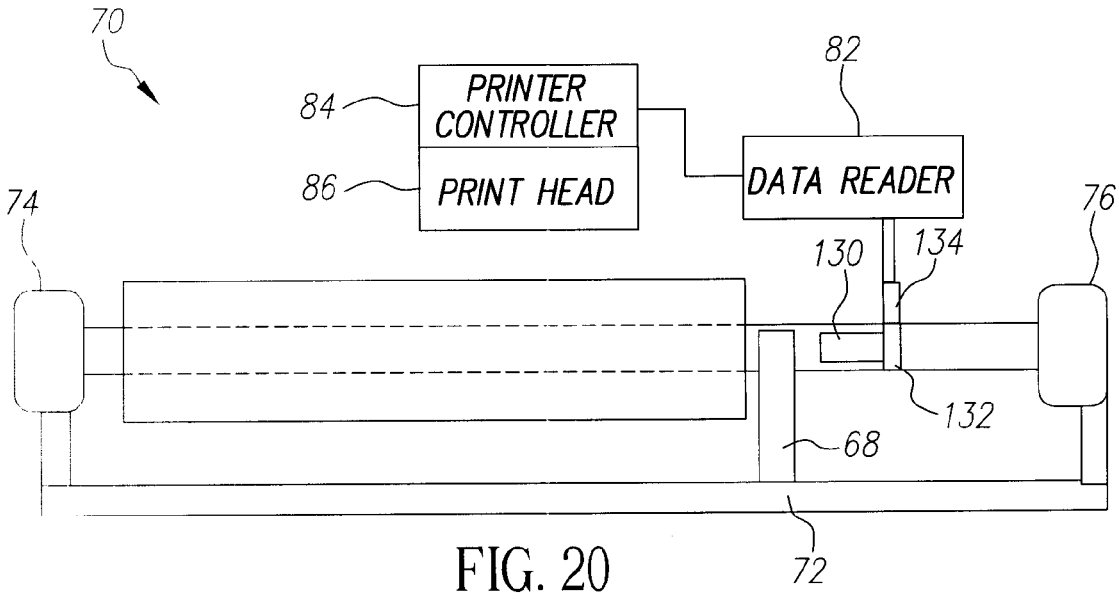
FIG. 20 illustrates another embodiment of an adapter of the present invention having a memory device associated therewith and installed in media holder of a first printer.

It will be appreciated that there are other ways in which body 110 can position a data source 118 so that data can be read therefrom when either of said first body end 112 and second body end 114 are joined to a first spool end 104 or second spool end 106. For example, in the embodiment shown in FIG. 20, data source 118 comprises a memory 130 having at least one contact 132 adapted to provide data therethrough to reader 82 when a contact 134 on reader 82 engages contact 132. In such an embodiment, body 110 positions contact 132 so that data can be read therefrom when either of first body end 112 or second body end 114 engage at least one of the first spool end 104 or the second spool end 106. Such memory 130 can provide the same data to reader 82, or memory 130 can have data stored therein and contact 132 can be adapted to provide data in more than one electronically readable form, with each form adapted to be read by a specific reader. Memory 130 can be adapted to sense which of the more than one readers (e.g. readers 82, 82') memory is connected to and to provide additional data.

In still another embodiment of the invention, data source 118 can comprise a memory 130 and a transponder 136 that is adapted to communicate with one or more readers 82 using at least one of a radio frequency, visible light signal, non-visible light signal or other electromagnetic signal. Memory 130 has data stored therein for use by more than one printer. The data provided can be the same for each printer or it can be different. Where the data in memory 130 is the same, the transponder can be adapted to determine data for transmission, or a manner of transmission to a reader based upon signals received from the reader.

Figure 21:
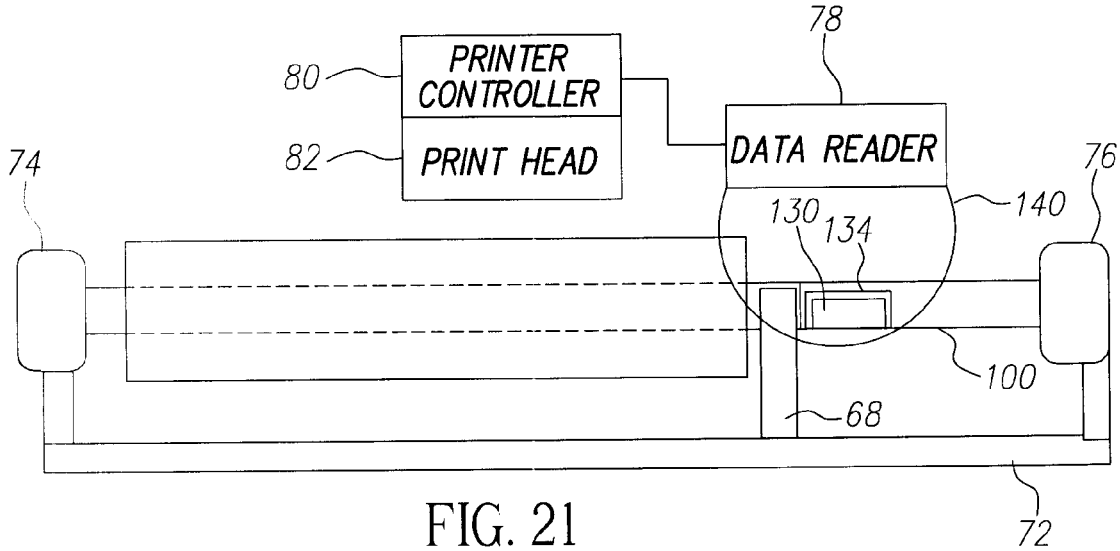
FIG. 21 illustrates another embodiment of an adapter of the present invention having a radio frequency transponder with a memory associated therewith and installed in a printer media holder of a first printer.
Figure 22:
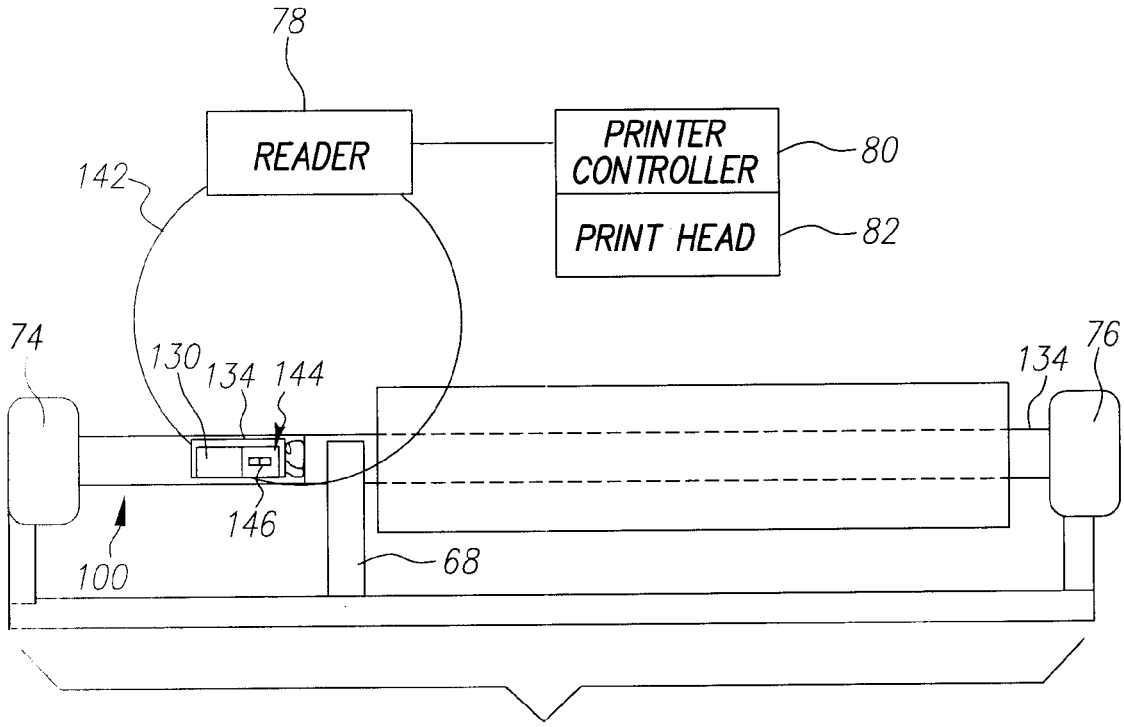
FIG. 22 illustrates another embodiment of an adapter of the present invention having a radio frequency transponder a with a memory associated therewith and installed in a printer media holder of a different printer.

In the embodiment of FIGS. 21 and 22, a transponder 136 is adapted to receive signals only when positioned within a range of positions proximate to a reader 82 in a printer 70. In such an embodiment, body 110 positions transponder 136 within a first range of positions 140 proximate to reader 82 in a printer 70 when first body end 112 is joined first spool end 104. Body 112 is also adapted to position transponder 136 within a second range of positions 142 proximate to reader 82' when the second body end 114 is joined to the second end 106 of spool 102.

The transponder 136 can be adapted to determine which data of more than one type of data stored in memory 130 is to be used. In one embodiment of the invention, transponder 136 has at least one sensor 144 from which transponder 136 can determine whether first body end 112 or the second body end 114 is connected to first spool end 104 and wherein transponder 136 selects data for transmission to transmission to a reader 82 based upon signals received from the sensor. Such a sensor can comprise a radio frequency, light or magnetic signal sensor that can determine based upon the type of signal provided, what data to transmit in response. In another embodiment of the invention, such a sensor can comprise, for example a user input such as a settable switch 146 that a user can use to cause a signal to be sent to the transponder 136 from which transponder 136 can determine what data to provide and in which form. Similarly, a switch, or other sensor, can be associated with body 110 so that when body 110 is joined to supply spool 102 in certain ways, the switch or sensor will sense the way in which body 110 is joined to a spool 102 and will send a signal to transponder 136 causing transponder 136 to communicate in a manner that is appropriate for the way in which adapter 100 is being used.

Figure 23:
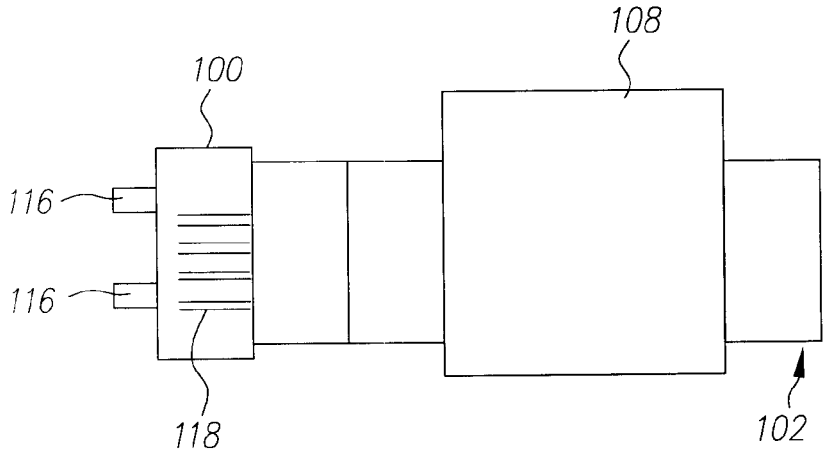
FIG. 23 illustrates an example in which various embodiments of the spool adapter can be positioned on a spool to conform the spool for use in printers having the mechanical adaptations described in FIGS. 5 and 6.

As is shown in FIG. 23, the adapter of the invention can also be used to conform the shape, length or diameter one end of a supply spool 24 so that it can cooperate with receptacles and other mis-loading prevention features discussed with reference to FIGS. 5 and 6 respectively. For example, as shown in FIG. 23, adapter 100 can modify the diameter of supply spool 102 and can optionally be color-coded to help ensure that the adapter 100 is being used with the proper spool and/or printer combination.

Figure 24:
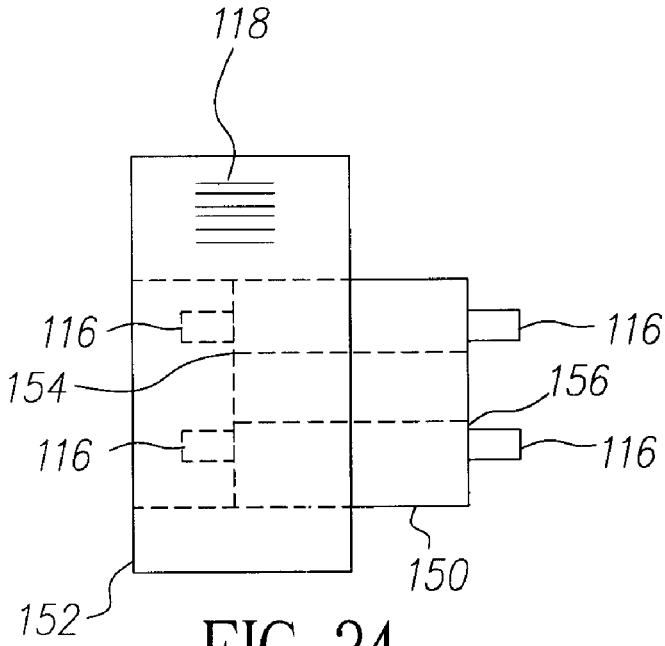
FIG. 24 shows another embodiment of an adapter with a movable data source in a first position.
Figure 25:
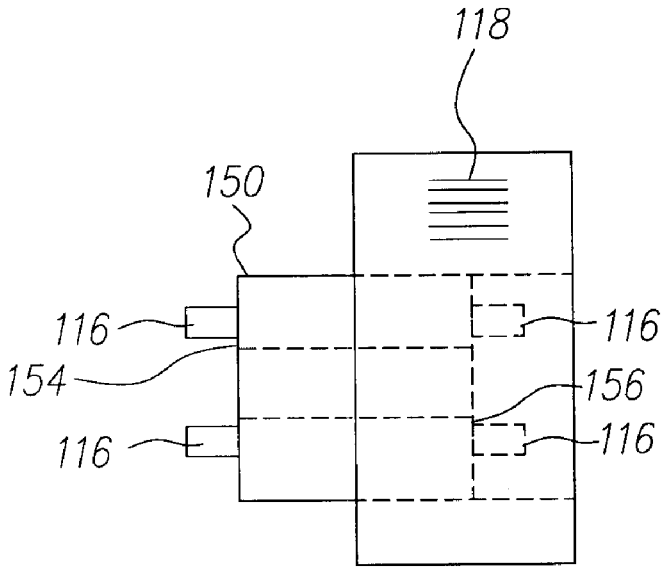
FIG. 25 shows the embodiment of FIG. 24 with the data source in a second position.

FIGS. 24 an 25 show another embodiment of this type wherein adapter 100 has a body 110 with a first body portion 150 and a second body portion 152, slidably joined thereto so that, as shown in FIG. 24, in one application first body portion 150 provides a first contact surface 154 and a second contact surface 156 with projection 116 that are adapted to allow body 110 to be joined to a spool (not shown). Second body portion 152 is slidably adjustable relative to first body portion 150 so that data source 118 can be positioned at any desired position or at one of a predetermined number of positions relative to first body portion 152, one example of which is shown in FIG. 25.

While the invention has been described with particular reference to embodiments, it will be understood by those skilled in the art that various changes may be made and equivalents may be substituted for elements of the preferred embodiment without departing from the invention. For example, the in certain devices mechanical stop 68 could be formed on the supply spool, or on adapter 100 to cooperate with the receptacle bracket or the door to prevent improper loading. In addition, many modifications may be made to adapt a particular situation and material to a teaching of the invention without departing from the essential teachings of the present invention.

The present invention provides an adapter that allows a universal spool to be loaded into a cartridge free dye donor loading system that is simple to use and that prevents incorrect insertion of the spools. An operator cannot insert the spools incorrectly. It also provides simple access to the spools for easy insertion and removal. The mechanical stop always ensures correct insertion of the supply spool with an off-center dye donor web.

The invention has been described in detail with particular reference to certain preferred embodiments thereof, but it will be understood that variations and modifications can be effected within the spirit and scope of the invention.

Parts List

10 loading apparatus
12 donor web
12' donor web
14 base portion
16 door portion
18 receptacle
19 bracket
20 slot
22 end portion
24 supply spool
24*a*, 24*a*', 24*a*", 24'" supply spool
24*b*, 24*b*', 24*b*" takeup spool
26 tapered portion
28 first means for biasing the first receptacle
30 coiled spring
32 bracket
34 means for detecting when first guide receptacle is in locked position
36 microswitch
38 second receptacle
40 biasing means
42 third receptacle
44 fourth receptacle
60 first end portion
62 second end portion
64 first end portion
66 second end portion
68, 68' stop member
70, 70' printer
72 holder
74 first receptacle
76 second receptacle
78 markings
80 area
82, 82' reader
84, 84' printer controller
86, 86' print head
88 memory
90 contact
92 reader contact

94 transponder
96 range
100 adapter
102 supply spool
104 first spool end
106 second spool end
108 web
110 adapter body
112 first body end
114 second body end
115 recesses
116 projections
118 data source
120, 120' adapter/spool assembly
122 first set of data
124 second set of data
130 memory
132 contact
134 reader contact
136 transponder
140 first range of positions
142 second range of positions
144 sensor
146 switch
150 first body portion
152 second body portion
154 first contact surface
156 second contact surface

The invention claimed is:

1. An adapter for use with supply spool having first and second spool ends, said spool having a web media thereon, said adapter comprising:

a body having first and second body ends with each of the first and second body ends having shaped linkages to join to one of the first and second supply spool ends and each body end further shaped to join to a printer receptable when not joined to a spool end; and a data source;

said body shaped to position the data source relative to the first body end so that so that when the first body end is joined to a first spool end, the data source is positioned to provide the machine readable data so that the machine readable data can be read by a reader in a printer that is adapted to accept a supply spool having web media that is axially located asymmetrically on the spool.

2. The adapter of claim 1, wherein said data source comprises at least one of characters, numbers, bar code markings, symbols, encodements, watermarks, or other indicia on the body that can be detected based upon a pattern of light that reflects from the body, said body positioning said data source so that data can be read therefrom when either of said first body end and second body end are joined to the first spool end.

3. The adapter of claim 1, wherein said data source comprises a first set of characters, numbers, bar code markings, symbols, encodements, watermarks, or other indicia on the body that can be detected based upon a pattern of light that reflects from the body so that when the first end of the body is joined the first end of the spool, rotation of the body the visible indicia to a reader in the sequence, and wherein the data source further comprises a second set of data positioned on the body so that the second set on the body can be detected based upon a pattern of light that reflects from the body as the body rotates when the second body end is connected to the first spool end.

4. The adapter of claim 1, wherein said data source provides different data to a reader when the first body end is joined to the first spool end than the data source provides to a reader when the second body end is joined to the first spool end.

5. The adapter of claim 1, wherein said data source provides data adapted to be read and used by one type of printer when the first body end is joined to the first spool end and further provides data that is adapted to be read and used by another type of printer when the when the second body end is joined to the first spool end.

6. The adapter of claim 1, wherein said data source comprises a memory having at least one contact adapted to provide data therethrough to a reader when a reader engages the at least one contact, and wherein said body positions the at least one contact so that data can be read therefrom when either of the first body end and the second body end is joined to the first spool end.

7. The adapter of claim 1, wherein said data source comprises a memory having data stored therein and at least one contact adapted to provide data in more than one electronically readable form, with each form adapted to be read when a contact from a reader in a particular printer connects with the at least one contact.

8. The adapter of claim 1, wherein said data source comprises a memory and a transponder that is adapted to communicate with a reader using at least one of a radio frequency, visible light signal, non-visible light signal or electromagnetic signal.

9. The adapter of claim 8, wherein said data source comprises a memory that has data stored therein for use by more than one printer, and wherein said transponder is adapted to determine data for transmission to a reader based upon signals received from the reader.

10. The adapter of claim 9, wherein said data source comprises a memory that has data stored therein for use by more than one printer, and wherein said transponder has at least one sensor from which the transponder can determine whether the first body end or the second body end is connected to the first spool end and wherein said transponder selects data for transmission to transmit to a reader based upon signals received from the sensor.

11. The adapter of claim 9, wherein said transponder is adapted to receive signals only when positioned within a range of positions proximate to a reader device in a printer, and wherein said body positions said transponder within a first range of proximate positions of a first reader in a first printer when the first body end is joined to the first spool end, and wherein said body positions said transponder within a second range of proximate positions of a second reader when the second end of the body is joined to the first end of the spool.

12. The adapter of claim 1, wherein said body is further shaped to position the data source so that when the second body end is joined to one of the spool ends, the data source is positioned to provide machine readable data so that the machine readable data can be read by a reader in a printer that is adapted to accept a supply spool having media that is axially located asymmetrically closer to other spool end.

13. The adapter of claim 1, wherein the body is further adapted so that the first body end can further be joined to the second spool end and so that the second body end can be joined to the first spool end.

14. An adapter for use with a supply spool having first and second spool ends with media wound about said supply spool so that the media is generally equidistant from the spool ends, said adapter comprising:

a body having first and second body ends with each of the first and second body ends having shaped linkages to join to a respective one of the first and second supply ends and further shaped to join to a printer axel when not joined to a spool end;

said body further comprising a data source positioned thereon;

said body positioning the data source relative to the first body end so that when the first body end is joined to the first spool end, the data source is positioned to provide the machine readable data so that the machine readable data can be read by a reader in a printer that is adapted to accept a supply spool having media that is axially located asymmetrically closer to the second end; and said body further positioning the data source so that when the second body end is joined to the second spool end, the data source is positioned to provide machine readable data so that the machine readable data can be read by a reader in a printer that is adapted to accept a supply spool having media that is axially located asymmetrically closer to the first end.

15. The adapter of claim 14, wherein the body is adapted to present the data source to provide the same data to each printer in the same sequence.

16. The adapter of claim 14, wherein the data source is adapted to provide data useful to a first printer when the first end of the body is joined to a first end of the spool and data that is useful to a second printer when the second end of the body is joined to the second end of the spool.

17. The adapter of claim 14, wherein the data source comprises at least one of an indicia on the body, memory adapted to exchange data through an electrical contact with the contact, and a memory and a transponder circuit adapted to exchange data using wireless signals.

18. An adapter comprising:

a data means for providing machine-readable data; and an extension means for extending the length of a spool having two ends; said extension means having at means for connecting to at least one spool;

wherein the means for connecting provides more than one manner for connecting the extension means to an end of the spool for rotation therewith, and wherein the extension means positions the data means so that the data means can be read by a reader in a printer that is adapted to receive an extension means that is connected to a spool in any of the more than one manner.

19. The adapter of claim 18, wherein the extension means is color-coded to match a color of a receptacle in a printer.

* * * * *

UNITED STATES PATENT AND TRADEMARK OFFICE

CERTIFICATE OF CORRECTION

PATENT NO. : 7,594,771 B2
APPLICATION NO. : 11/020404
DATED : September 29, 2009
INVENTOR(S) : Robert F. Mindler It is certified that error appears in the above-identified patent and that said Letters Patent is hereby corrected as shown below:

| | |
|---|---|
| Column 13, lines 36-37 | In Claim 1, delete "receptable" and insert -- receptacle --, therefor. |
| Column 13, line 40 | In Claim 1, after "so that" delete "so that". |
| Column 14, line 8 | In Claim 5, after "when the" delete "when the". |

Signed and Sealed this

Fifth Day of January, 2010

David J. Kappos

David J. Kappos
*Director of the United States Patent and Trademark Office*